US005753323A

United States Patent [19]

Andrus

[11] Patent Number: 5,753,323

[45] Date of Patent: May 19, 1998

[54] PALMETTO PATTERN CAMOUFLAGE

[76] Inventor: Chris Wayne Andrus, 2035 Edwards St., Opelousas, La. 70570

[21] Appl. No.: 609,350

[22] Filed: Mar. 1, 1996

[51] Int. Cl.[6] ..... F41H 3/00

[52] U.S. Cl. ..... 428/17; 2/900; 428/21; 428/919

[58] Field of Search ..... 428/15, 17, 919, 428/21; 2/900

[56] References Cited

U.S. PATENT DOCUMENTS

| | | | |
|---|---|---|---|
| D. 326,363 | 5/1992 | Cooper | 428/919 X |
| 4,656,065 | 4/1987 | Yacovella | 428/17 |
| 4,865,900 | 9/1989 | Shannon et al. | 428/919 X |
| 4,868,019 | 9/1989 | Knickerbocker | 428/919 X |
| 5,077,101 | 12/1991 | Conway et al. | 428/919 X |
| 5,445,863 | 8/1995 | Slagle et al. | 428/17 X |

OTHER PUBLICATIONS

Gander Mountain, pp. 72&73 regarding camouflage, 1995 Archery catalog.

*Primary Examiner*—Henry F. Epstein
*Attorney, Agent, or Firm*—William W. Stagg

[57] ABSTRACT

A camouflage pattern for use on clothing and other articles for concealing a hunter or outdoorsman in a forest undergrowth comprised primarily of fan-shaped palmetto palm plants. The pattern is comprised of a background of varying shades of gray overlaid by successive patterns of plants having extending, long, flat, fan-shaped, pointed, finger-like medium green foliage so as to depict fan-shaped palmetto palm plants intermittently interspersed with plants having downwardly bent, long, flat, fan-shaped, pointed, finger-like brown foliage. The plants of each successive pattern being smaller than those of the preceding pattern and having a slightly lighter shade of green foliage than that of the preceding pattern.

15 Claims, 2 Drawing Sheets

PALMETTO PATTERN CAMOUFLAGE

FIELD OF INVENTION

The present invention generally relates to the field of camouflage patterns and, more particularly, it relates to an improved camouflage pattern for use on hunting clothing, cloth and other articles which incorporates a foreground pattern of fan-shaped palmetto palm leaves, an intermediate pattern comprised of a tangle of vines and secondary leaves, and a gray background to blend into a forest environment comprised primarily of an undergrowth of fan-shaped palmetto palm leaves that are common in the swampy forests and woodlands prevalent along the gulf coast of the United States.

BACKGROUND OF THE INVENTION

Over the years a variety of camouflage design patterns have been utilized to improve the concealment techniques utilize by hunters, bird watchers and others engaged in outdoor activities. These designs typically employ splotches of brown or green in different shades over a contrasting background such as the brown and green camouflage patterns used by the military during and since World War II.

Other designs for camouflage patterns include those disclosed in U.S. Pat. No. 4,656,065 to Yacovella for Bark Camouflage Cloth and Outer Garments and U.S. Pat. No. 4,865,900 to Shannon et al for Article having Concealing Pattern. The camouflage cloth of Yacovella attempts to mimic the rough bark of a tree by utilizing a disruptive pattern of highly elongated vertical ribs and channels in earthtones having vertical black shadows along the edges of the ribs. It being thought that a camouflage that generally mimics the vertical bark lines of a real tree will provide a superior camouflage for the hunter to that having splotches of dark and light shades or that which attempts to mimic the bark of a particular type of tree. The camouflage pattern of Shannon et al discloses a pattern adapted for concealment in a leafy environment. It consists of a pattern having a first color forming dark leaf and twig shapes of a generally biconvex curvilinear outline a second color forming a generally lighter background, the first color comprising the major portion of the surface pattern. It being thought that such biconvex curvilinear shapes and colors approximate the leafy plants thought to be typical of a forest undergrowth. Other camouflage patterns utilized designs which incorporate leaf shapes, especially oak leaf shapes, and the shapes and colors simulating the bark on trees such as those sold under the trademarks Realtree® and Mossy Oak® or described in U.S. Pat. No. D326,363 to Cooper.

The aforementioned designs do not address the problems associated with camouflage in an undergrowth of fan-shaped palmetto palms. The leaves of the fan-shaped palmetto palm, particularly that found in the forests of Louisiana and along the Gulf Coast of the United States, are flat, fanned, long, pointed with finger-like segments and are typically dark green. These leaves are typically evergreen and stay dark green during the fall and winter months even when surrounding vegetation has started to turn or has turned brown. The fan-shaped palmetto palm leaves typically turn brown only when the plant is damaged. When that occurs, an undergrowth comprised primarily of fan-shaped palmetto palms consists of thick clumps of plants having dark green, fanned, flat, long, pointed, finger-like leaves. These clumps are interspersed with the brown leaves of the same shape from broken or damaged palm plants and the twigs, vines and leaves of secondary vegetation.

The aforementioned camouflage patterns do not attempt to nor do they adequately mimic the colors, shapes and shadings associated with an undergrowth comprised principally of the fan-shaped palmetto palm plant. The rounded leaf shapes and vertical trunk shaped images suggested for concealment by the foregoing designs stand out against a background comprised of non-round, generally flat, fan-shaped, long, finger-like foliage typical of the fan-shaped palmetto palm undergrowth that is found in the forests of the United States Gulf Coast. Thus, the foregoing suggested camouflage patterns do not adequately serve their intended purpose of concealment. Consequently, a need exists for an improved camouflage pattern for use on clothing and other articles to aid in concealing sportsmen, hunters, bird watchers and other outdoor enthusiasts in the coastal forests of the United States Gulf Coast where the fan-shaped palmetto palm comprises a substantial portion of the forest undergrowth.

SUMMARY OF THE INVENTION

The present invention is designed to present a camouflage pattern to satisfy the aforementioned needs. It is comprised of a multi-layered pattern depicting fan-shaped palmetto palm plants, including the palm plants stems, leaves, and seeds, interspersed with the vines and leaves of secondary plants over a gray background. The gray background surface has a gradual, smooth and continuous transition from areas of light gray to darker gray to charcoal and then a gradual, smooth, and continuous transition back along the gray spectrum to light gray. This transition of shades of gray is to enhance the shadow effects and accentuate the illusion of depth in the pattern.

The preferred embodiment of the camouflage pattern has over a gray background having areas of gray that smoothly transition from light gray to charcoal gray over a pattern of fan-shaped palmetto palm plants. The foreground of the palmetto palm pattern is comprised of a first pattern layer of nearly actual sized, fan-shaped palmetto palm plant leaves, the leaves of the first pattern layer being colored a medium dark green shade to simulate the natural color of the plant and a mid-ground second pattern layer of fan-shaped palmetto palm plant leaves, the leaves of the second pattern layer being a lighter shade of green than the first layer and sized smaller than those leaves of the first pattern layer. This shift in size and color from the first pattern layer to the second pattern layer is to give an appearance of depth of field to the resulting combination of pattern layers.

Additional leaves in each pattern layer of fan-shaped palmetto palm plant leaves are included and are intended to be bent and folded downward in appearance to simulate the appearance of dead or damaged plants. Interwoven with and between the aforementioned layers are vines, leaves and twigs of varying sizes and shades of green and brown to simulate secondary foliage, such as poison ivy vines and leaves, that is common to a forest having palmetto palm plants.

It is therefore an object of the invention to provide a camouflage pattern for use on clothing and other articles to aid in concealing a hunter or outdoorsman in forest undergrowth comprised primarily of fan-shaped palmetto palm plants.

It is also an object of the invention to provide a camouflage pattern for use on clothing and other articles for concealing a hunter or outdoorsman in a forest undergrowth comprised primarily of plants having non-round, generally flat, fan-shaped, long, pointed, finger-like foliage.

It is also an object of the invention to provide a camouflage pattern for use on clothing and other articles to aid in concealing a hunter or outdoorsman in forest undergrowth comprised primarily of evergreen plants.

It is also an object of the invention to provide a camouflage pattern for use on clothing and other articles to aid in concealing a hunter or outdoorsman in forest undergrowth comprised primarily of evergreen fan-shaped palmetto palm plants over a gray background that transitions smoothly from areas of light gray to charcoal gray over the gray spectrum.

DESCRIPTION OF THE PREFERRED EMBODIMENTS

Figure 1:
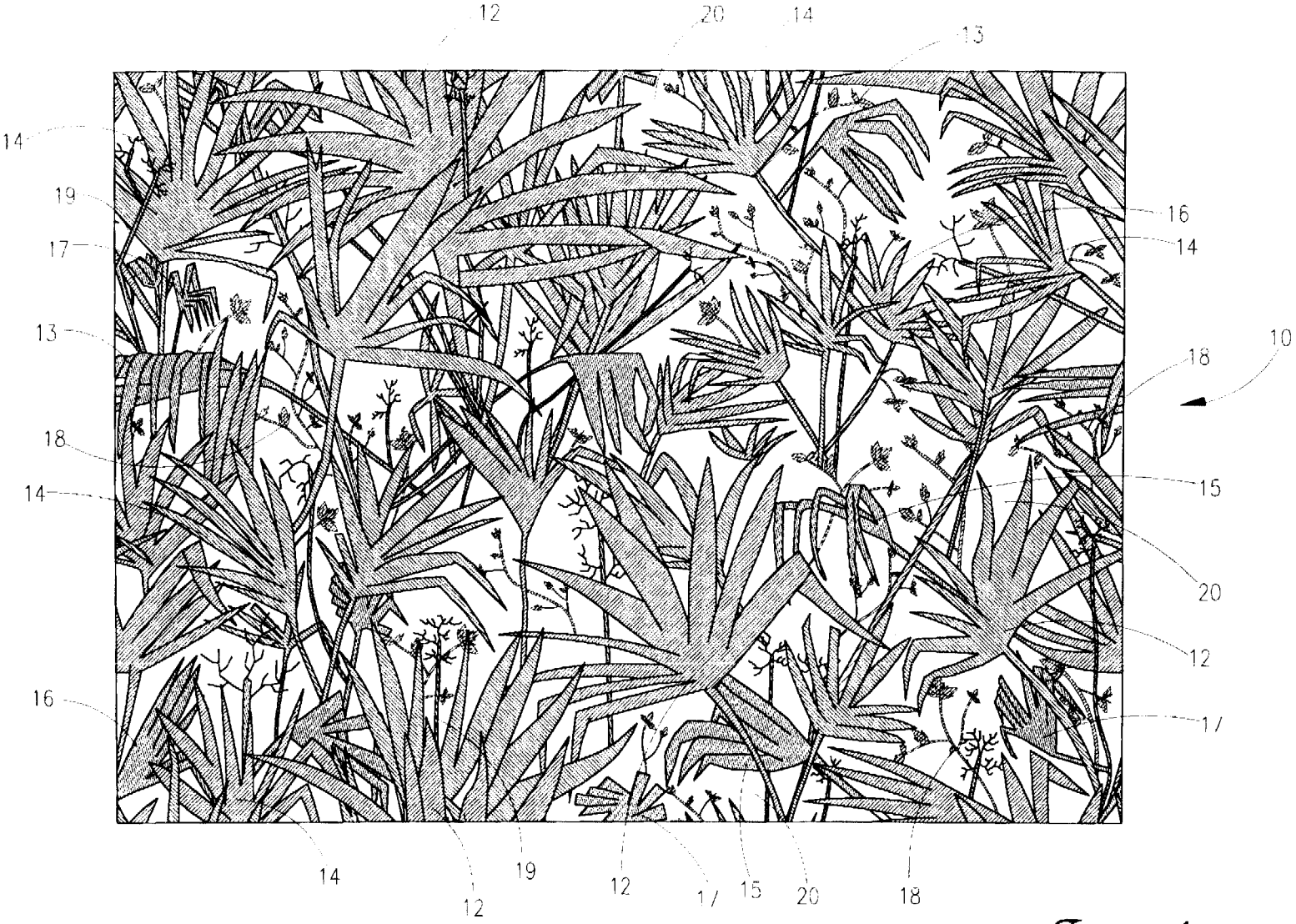
FIG. 1 is a reduced sized representation of the preferred palmetto camouflage pattern.

And now, referring to the drawings and more particularly to FIG. 1, there is shown in reduced size the camouflage pattern 10 of applicant's invention. In the preferred embodiment. The pattern 10 is comprised primarily of groupings or layers depicting fan-shaped palmetto palm plants 12, 14 and 16 over a gray background 20. As shown in FIG. 1, overlaying the gray background 20 of the camouflage pattern 10 there is a foreground grouping of nearly life size fan-shaped palmetto palm plants 12. The foreground grouping is comprised primarily of plants fan shaped palmetto palm plants 12 having medium dark green, fan-shaped, outwardly extending, finger-like leaves though, spaced intermittently throughout the grouping, are palmetto palm plants 13 having brown, downwardly bent, fan-shaped, finger-like leaves to simulate dead or dying palmetto plants.

In addition to the foreground grouping of plants 12, the pattern 10 has a first mid-ground grouping of plants consisting primarily of fan-shaped palmetto palm plants 14. The plants 14 of the first mid-ground grouping are of the same shaped as the plants 12 but of a lighter shade of green and are slightly smaller than the plants 12 to give the appearance of depth to the pattern 10. As with the plants 12 of the foreground grouping, the first mid-ground grouping has a plurality of fan-shaped palmetto palm plants 15 having brown, downwardly bent, finger-like leaves spaced intermittently throughout the grouping of plants 14 to again simulated dead or dying palmetto palm plants.

A second mid-ground grouping of fan-shaped palmetto palm plants 16 is also placed in the pattern 10. The plants 16 of the second mid-ground grouping are of the same general shape and color as those plants 14 of the first mid-ground grouping but are sized to be slightly smaller than the plants 14 to further enhance the depth of field appearance of the pattern 10. As with the plants 12 and 14 of the preceding groupings, the second mid-ground grouping has a plurality of fan-shaped palmetto palm plants 17 having brown, downwardly bent, finger-like leaves spaced intermittently throughout the grouping of plants 16 to simulated dead or dying palmetto palm plants. Interwoven throughout each of the groupings of fan-shaped palmetto palm plants 12, 14, and 16 of the pattern 10 are the vines and leaves 18 of the poison ivy plant. The poison ivy plant being selected for the pattern 10 since it is a plant common to the forest undergrowth where the fan-shaped palmetto palm is prevalent. The poison ivy vines and leaves 18 are placed through out the pattern 10 and the poison ivy vines and leaves 18 vary in size, some vines and leaves 18 being small and some being large, to further enhance the illusion of depth provided by the pattern 10. In addition to the poison ivy vines and leaves 18, the pattern is interspersed with a depiction of the stalks and berries 19 of the palmetto palm plant of sizes that correspond to the plants 12, 14 and 16.

While the background 20 is shown white in FIG. 1, the underlying gray background 20 of the pattern 10 has contiguous areas of gray that gradually and smoothly transitions up the grey spectrum from areas of light gray to darker gray to charcoal gray and then back down to the gray spectrum to areas of light gray. This repeated transition from areas of light gray to areas of darker gray in the background 20 of the pattern 10 is intended to again enhance the perception of depth in the viewer that is brought on by the overlying groupings of palm plants.

Figure 2:
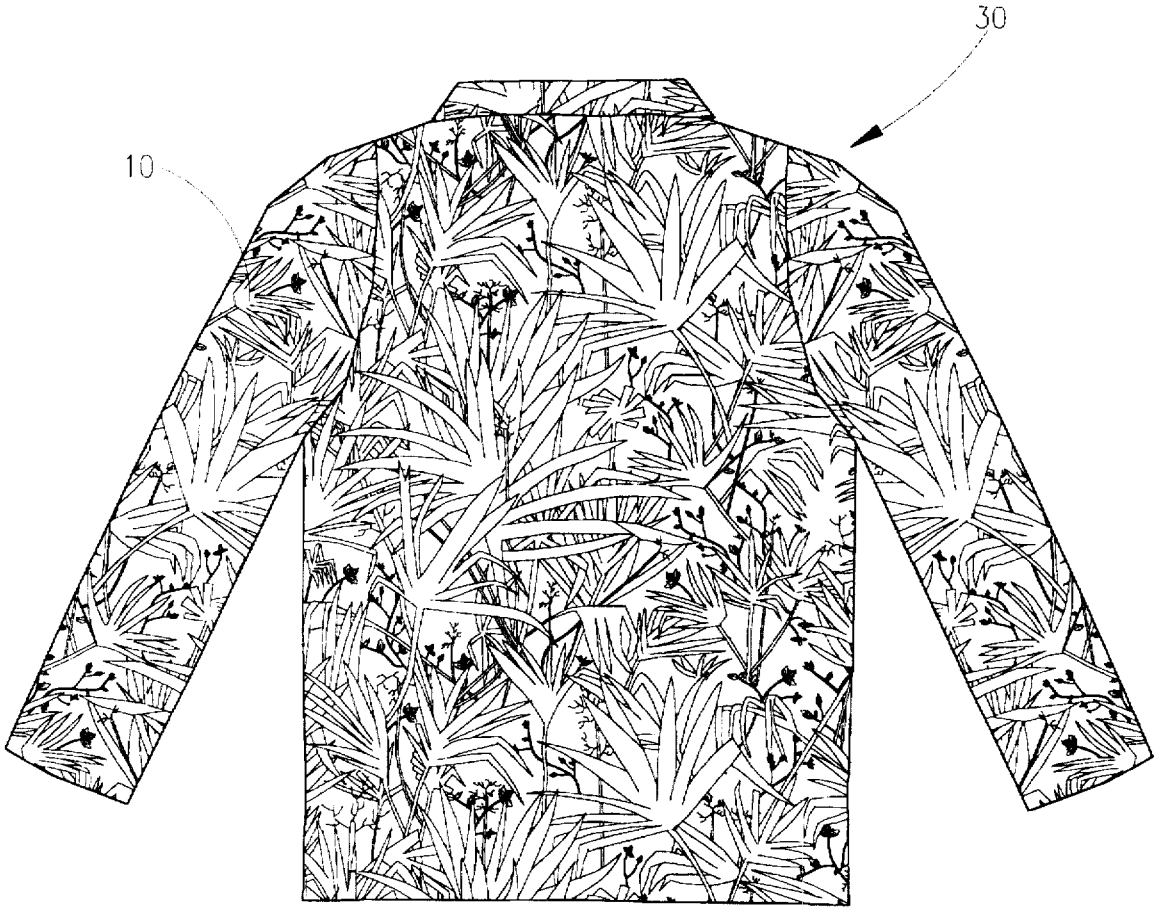
FIG. 2 is a back view of a jacket made from cloth printed with the palmetto camouflage pattern.

FIG. 2 is a back view of a jacket 30 made from cloth over which is imprinted the camouflage pattern 10 and is intended to illustrate the use of the camouflage pattern of an article of hunting clothing. The pattern 10 may also be utilized with other articles of clothing such as pants, shirts, caps, boots and shoes. The use of the camouflage pattern 10 can be extend to other articles such knapsacks, bags and blind materials or to other clothing such as overcoats and rainwear and is intended for use on any article for which camouflage is desirable. It being the current trend to utilize printed camouflage patterns on many different kinds of articles, not only for its functional aspects but for its ornamental nature, the camouflage pattern 10 is adaptable to such uses.

It is thought that the camouflage pattern of the present invention and many of its attendant advantages will be understood from the foregoing description and it will be apparent that various changes may be make in the form, construction and arrangement of the parts thereof without departing from the spirit and scope of the invention or sacrificing all of its material advantages, the form described herein being merely a preferred or exemplary embodiment of the invention.

I claim:

1. A camouflage pattern comprising:

(a) a background of varying shades of gray, said gray background having contiguous areas of gray that gradually and smoothly transition up the gray spectrum from areas of light gray to charcoal gray and then having a gradual and smooth transition down the gray spectrum to areas of light gray;

(b) a foreground plant grouping comprising a plurality of nearly life-size fan-shaped palmetto palm plants overlaying said gray background, said plants of said foreground plant grouping having outwardly extending, fan-shaped leaves primarily of medium dark green color interspersed with a plurality of fan-shaped palmetto palm plants having brown, downwardly bent, fan-shaped leaves;

(c) a first mid-ground grouping of fan-shaped palmetto palm plants overlaying said gray background, said plants of said first mid-ground grouping having outwardly extending, fan-shaped leaves slightly smaller and of a lighter green color than those of said plants of said foreground grouping said first mid-ground grouping being interspersed with a plurality of fan-shaped palmetto palm plants having brown, downwardly bent, fan-shaped leaves;

(d) a second mid-ground grouping of fan-shaped palmetto palm plants overlaying said gray background, said second mid-ground grouping having outwardly extending, fan-shaped leaves slightly smaller and of a lighter green color than those of said first mid-ground grouping said second mid-ground grouping being interspersed with brown, downwardly bent, fan-shaped palmetto palm plant leaves; and (e) a plurality of poison ivy-shaped vines and leaves of varying sizes and of a color varying in shade from light green to dark green, said poison ivy-shaped vines and leaves being interwoven throughout each of said palmetto palm plant groupings.

2. A camouflage pattern for use on clothing for concealing a hunter or outdoorsman in a forest undergrowth of fan-shaped palmetto palm plants further comprising:

(a) a background comprised of varying shades of gray;

(b) a foreground pattern of said fan-shaped palmetto palm plants overlaying said background, said foreground pattern having a plurality of said fan-shaped palmetto palm plants with outwardly extending, long, flat, fan-shaped, pointed, medium dark green foliage intermittently interspersed with said fan-shaped palmetto palm plants having downwardly bent, long, flat, fan-shaped, pointed, brown foliage; and (c) a plurality of successive mid-ground patterns of said fan-shaped palmetto palm plants overlaying said background, said mid-ground patterns having a plurality of said fan-shaped palmetto palm plants with outwardly extending, long, flat, fan-shaped, pointed, green foliage intermittently interspersed with a plurality of fan-shaped palmetto plants with downwardly bent, long, flat, fan-shaped, pointed, brown foliage, each of said successive mid-ground patterns being smaller than its preceding pattern and having a slightly lighter shade of green foliage.

3. A camouflage pattern as recited in claim 2, wherein said fan-shaped palmetto palm plants of said foreground pattern are approximately life size.

4. A camouflage pattern as recited in claim 3, wherein said gray background varies in shade with contiguous areas of gray that gradually and smoothly transition up the gray spectrum from areas of light gray to areas of charcoal gray and then gradually and smoothly transition down the gray spectrum to areas of light gray.

5. A camouflage pattern as recited in claim 4, further comprising a plurality poison ivy-shaped vines and leaves of varying sizes and of a color varying in shade from light green to dark green, said poison ivy-shaped vines and leaves being interwoven throughout each of said patterns of plants.

6. A camouflage pattern for use on clothing and personal equipment for concealing a hunter or outdoorsman in a forest undergrowth comprised primarily of fan-shaped palmetto palm plants comprising:

(a) a gray background; and (b) a plurality of successive patterns depicting fan-shaped palmetto palm plants, including plant stalks and berries, overlaying said background, said successive patterns having plants depicted with outwardly extending, long, flat, fan-shaped, pointed foliage so as to mimic the foliage of a fan-shaped palmetto palm, said successive patterns having plants of a size smaller than those of the immediately preceding pattern and of a lighter shade.

7. A camouflage pattern as recited in claim 6, wherein the depiction of said fan-shaped palmetto palm plants in the largest of said successive patterns of plants is approximately life size.

8. A camouflage pattern as recited in claim 7, wherein said depiction of said fan-shaped palmetto palm plants in the largest of said successive patterns are of substantially the same color as that of fan-shaped palmetto palms.

9. A camouflage pattern as recited in claim 8, wherein said gray background varies in shade with contiguous areas that gradually and smoothly transition up the gray spectrum from areas of light gray to areas of charcoal gray and then gradually and smoothly transition down the gray spectrum to areas of light gray.

10. A camouflage pattern as recited in claim 9, further comprising a depiction of a plurality of poison ivy-shaped vines and leaves of varying sizes and of a color varying in shade from light green to dark green, said depiction of said plurality of poison ivy-shaped vines and leaves being interwoven throughout each of said successive patterns.

11. A camouflage pattern comprising:

(a) a background pattern, said background comprising repeated and contiguous areas of gray shading, said gray shading of said contiguous areas being shaded so as to transition gradually and smoothly along the gray spectrum from areas of light gray to charcoal gray;

(b) a plurality of successive plant patterns overlaying said background, each of said successive patterns depicting a plurality of fan-shaped palmetto palm plants so as to have a series of preceding and succeeding patterns of said plants, each succeeding pattern being progressively smaller than the plants of its said preceding plant pattern, said successive patterns each having a plurality of plants with upwardly extending, fan-shaped leaves of a lighter green color than said leaves of its said preceding pattern interspersed with a plurality of fan-shaped palmetto palm plants having brown, downwardly bent, fan-shaped leaves.

12. A camouflage as recited in claim 11 wherein, said successive plant patterns include a plurality of vines and leaves of varying sizes and of a color varying in shade from light green to dark green, said vines and leaves being interwoven throughout each successive plant pattern.

13. A camouflage as recited in claim 12 wherein, said plurality of vines and leaves are shaped so as to depict poison ivy vines and leaves.

14. A camouflage pattern as recited in claim 13, wherein said plants of said successive plant patterns are of substantially the same color as that of fan-shaped palmetto palms.

15. A camouflage pattern as recited in claim 13, wherein the largest plants of said successive plant patterns depicting fan-shaped palmetto palm plants are nearly life-size.

* * * * *